US006550600B2

(12) United States Patent
Faes et al.

(10) Patent No.: US 6,550,600 B2
(45) Date of Patent: Apr. 22, 2003

(54) COIN ESCROW AND CHANGER APPARATUS

(75) Inventors: Steven M. Faes, Canisteo, NY (US); Joseph R. McGinty, Madion, AL (US)

(73) Assignee: Qvex, Inc., Madison, AL (US)

( * ) Notice: Subject to any disclaimer, the term of this patent is extended or adjusted under 35 U.S.C. 154(b) by 0 days.

(21) Appl. No.: 09/894,254

(22) Filed: Jun. 28, 2001

(65) Prior Publication Data

US 2002/0050438 A1 May 2, 2002

Related U.S. Application Data

(60) Provisional application No. 60/214,610, filed on Jun. 28, 2000.

(51) Int. Cl.[7] ..... G07F 1/04
(52) U.S. Cl. ..... 194/203; 194/217
(58) Field of Search ..... 194/346, 351, 194/230, 232

(56) References Cited

U.S. PATENT DOCUMENTS

| | | | | |
|---|---|---|---|---|
| 751,081 | A | | 2/1904 | Larned |
| 886,499 | A | | 5/1908 | Harrison |
| 1,098,673 | A | | 6/1914 | Lyng |
| 1,360,677 | A | | 11/1920 | Perry |
| 2,121,971 | A | | 6/1938 | Landreth |
| 2,451,776 | A | * | 10/1948 | Rush ..... 194/295 |
| 2,952,348 | A | | 9/1960 | Buchholz et al. |
| 3,146,907 | A | * | 9/1964 | Bookout ..... 221/67 |
| 3,177,290 | A | | 4/1965 | Norling et al. |
| 3,699,259 | A | | 10/1972 | Main et al. |
| 3,759,441 | A | | 9/1973 | Hamilton et al. |
| 4,630,624 | A | | 12/1986 | Turner |
| 4,782,937 | A | | 11/1988 | Chen et al. |
| 5,427,219 | A | * | 6/1995 | Kotler ..... 194/203 |
| 5,924,543 | A | | 7/1999 | Faes et al. |
| 6,039,165 | A | * | 3/2000 | Wild ..... 194/217 |
| 6,163,603 | A | | 12/2000 | McGinty et al. |

* cited by examiner

*Primary Examiner*—Eileen D. Lillis
*Assistant Examiner*—Michael J. Kwon
(74) *Attorney, Agent, or Firm*—Gardner Groff, PC

(57) ABSTRACT

A plurality of gates with control arms and cam arms that pivot to open and close a plurality of coin stalls, so that a coin will enter the first open stall, engage the cam arm to pivot the control arm to close that stall, and come to rest on one of a plurality of support arms. A coin select mechanism includes an actuator operatively connected to a coin select member with pins that engage slots with openings in the arms. The actuator is selectively operated to slide the coin select member to align one of the pins with the opening of one of the arms, to permit that arm to pivot to release the coin in that stall. A coin release mechanism includes an actuator operatively connected to a release member with pins that engage the release the arms so that only the desired coin stall is emptied.

29 Claims, 10 Drawing Sheets

COIN ESCROW AND CHANGER APPARATUS

CROSS REFERENCE TO RELATED APPLICATION

This application claims the priority benefit of U.S. Provisional Application No. 60/214,610, filed Jun. 28, 2000, which is hereby incorporated by reference in its entirety.

TECHNICAL FIELD

The present invention relates generally to coin-operated devices and, in particular, to a coin escrow and coin changer apparatus for use in a coin-operated device.

BACKGROUND OF THE INVENTION

In many coin-operated devices, a coin escrow/coin changer unit is provided to temporarily store coins and then to discharge coins to a customer. In conventional coin-operated devices, cylindrical coin stalls are provided for receiving and storing coins to be dispensed later. Such coin escrow/changer units are susceptible to jamming, wherein the unit is then unavailable to continue receiving and dispensing coins.

In another known prior art device, a revolving carousel is provided having a number of vertical coin stalls. In this arrangement, the coins are arranged in a ring, with adjacent coins facing one another. In order to load coins into the individual coin stalls, the carousel is rotated to present an empty stall to a coin admission gate through which a coin is moved into a coin stall. In order to discharge a coin from the carousel, the carousel is rotated until the coin to be discharged is positioned at a coin discharge gate to allow the coin to be discharged. Unfortunately, such a carousel arrangement disadvantageously requires that the entire carousel, including all of the coins contained in the carousel already, be rotated to admit an additional coin or to discharge a coin. This tends to require a powerful drive motor and tends to consume relatively large amounts of power. Indeed, in some applications, the power required to drive such a carousel is simply not available. For example, in coin-operated pay telephones, the power to operate the coin changer apparatus is delivered over the phone line itself in many instances, typically over great length and with many power loads inbetween. As a result, it often occurs that there is very little power left to drive such a carousel in a coin-operated pay telephone.

Accordingly, it can be seen that a need yet remains in the art for a coin escrow and coin changer apparatus which can be used in a coin-operated device and which has low power requirements. It is to the provision of such a coin escrow and coin changer apparatus that the present invention is primarily directed.

SUMMARY OF THE INVENTION

Briefly described, in a preferred from the present invention comprises a coin escrow and coin changer apparatus for use in a coin-operated device. The coin escrow and coin changer apparatus includes a frame with a descending coin guide slot along which coins can descend by gravity. The apparatus also includes a plurality of coin stalls that are arranged along the descending coin guide slot for temporarily storing coins. The coin stalls have gates that operate to admit a coin without requiring that any coins already in any other stall be moved. The apparatus further includes a coin select mechanism for selecting the stall to be emptied and a coin release mechanism for permitting the selected stall to be emptied, which cooperate to discharge a coin from one of the coin stalls without requiring that any coins in the other stalls be moved.

Preferably, the gates are pivotally mounted for moving between an open position for admitting a coin into one of the stalls and a closed position for denying admission of a coin. In the closed position, a coin in the descending coin guide slot encounters a control arm of the closed gate and descends past it to the next gate. Preferably, the movement of a coin into a coin stall engages a paddle of the gate that operates by the coin's own weight to close the gate. Thus, the apparatus allows coins to be moved into the coin stalls without requiring that the coin stalls be rotated or without requiring that existing coins already in the coin stalls be moved in order to accommodate a new coin being admitted.

Preferably, the coin select mechanism includes a plurality of lower movable arms associated with the plurality of coin stalls, and a coin select member that engages the arms for selectively unlocking a desired one of the lower movable arms so that a particular coin can be discharged from its coin stall. Preferably, the lower movable arms are assisted toward the open position by the weight of the coins themselves. Preferably, the release mechanism includes a plurality of pins that engage the arms to hold them in a locked position. The release mechanism can be configured to lock and unlock one movable arm at a time or it can be configured to lock and unlock all of the arms at one time. In this way, coins can be discharged from the apparatus one at a time or all at once.

Advantageously, the present invention allows coins to be admitted into the coin stalls using the coin's own kinetic and potential energy. Also advantageously, the apparatus allows coins to be discharged from the coin stalls with very low power requirements, particularly in comparison to known prior art arrangements.

BRIEF DESCRIPTION OF THE DRAWING FIGURES

DETAILED DESCRIPTION OF THE EXEMPLARY EMBODIMENT

Figure 1:
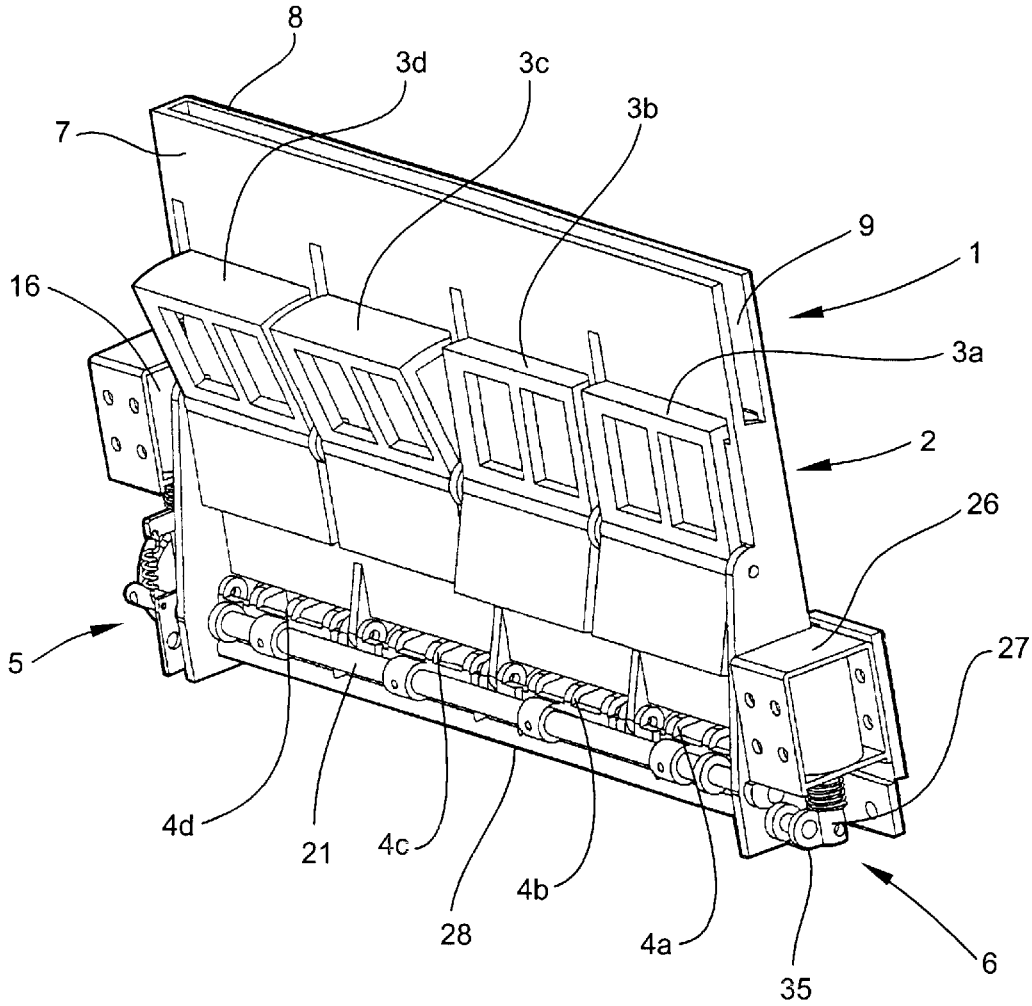
FIG. 1 is a right side perspective view of a coin escrow and coin changer apparatus according to a preferred from of the invention.
Figure 2:
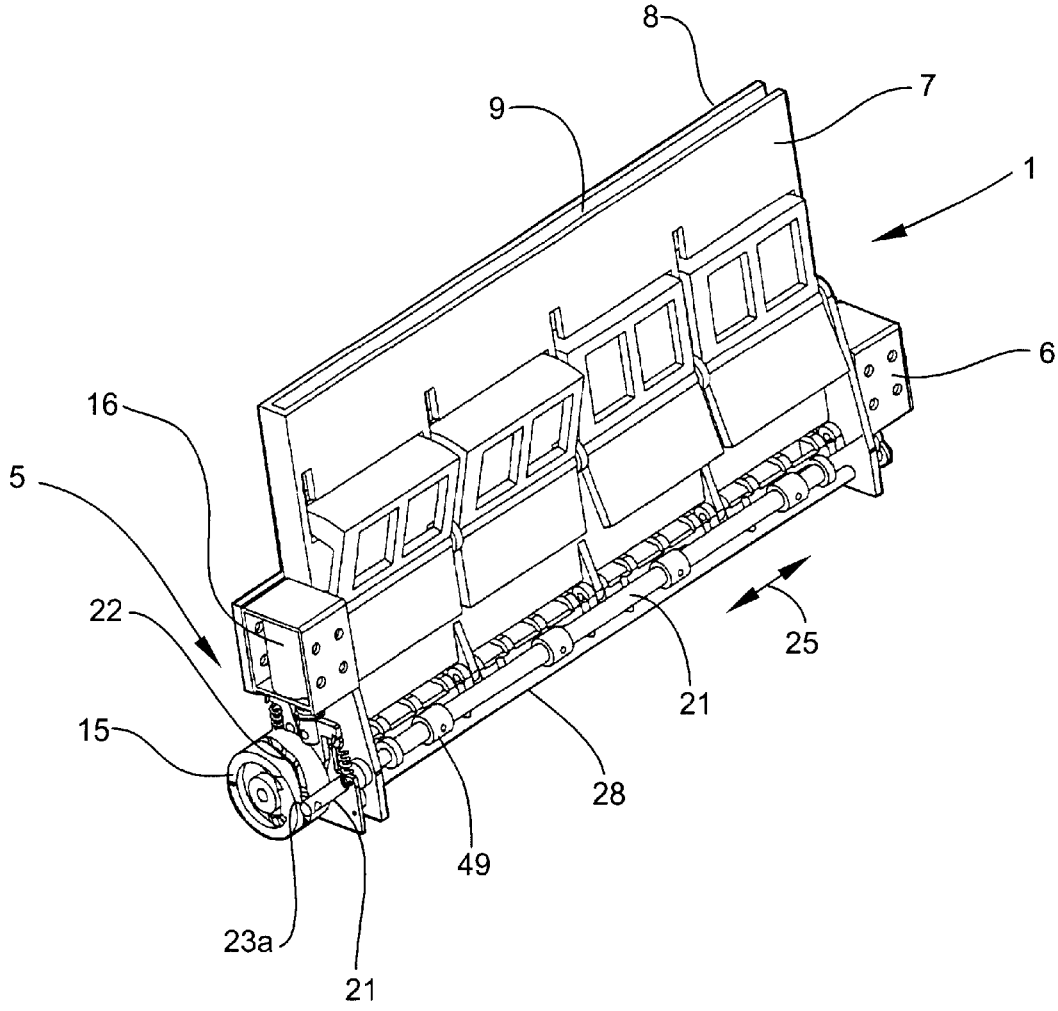
FIG. 2 is a left side perspective view of the apparatus of FIG. 1.

Referring now in detail to the drawing figures, wherein like reference numerals represent like parts throughout the several views, FIGS. 1–12 show an exemplary embodiment of a coin escrow and changer apparatus of the present invention, generally referred to as the coin change mechanism 1. The coin change apparatus 1 is mounted in (or onto) and used with a coin-operated device (not shown) such as a pay phone, vending machine, ticket dispenser, and so forth. The coin change apparatus 1 includes a frame 2, a series of gates 3*a*–3*d* (referred to collectively as the "gates 3") pivotally mounted to the frame, a series of pivotally mounted support arms 4*a*–4*d* (referred to collectively as the "arms 4") pivotally mounted to the frame, a coin select mechanism 5, and a coin release mechanism 6. The frame 2, gates 3, and support arms 4 can be made of metal, plastic, or another material, by fabrication techniques known in the art. For illustration purposes, the apparatus 1 is shown with four gates 3 and four support arms 4, however, another number of gates 3 and arms 4 can be suitably provided.

Figure 3:
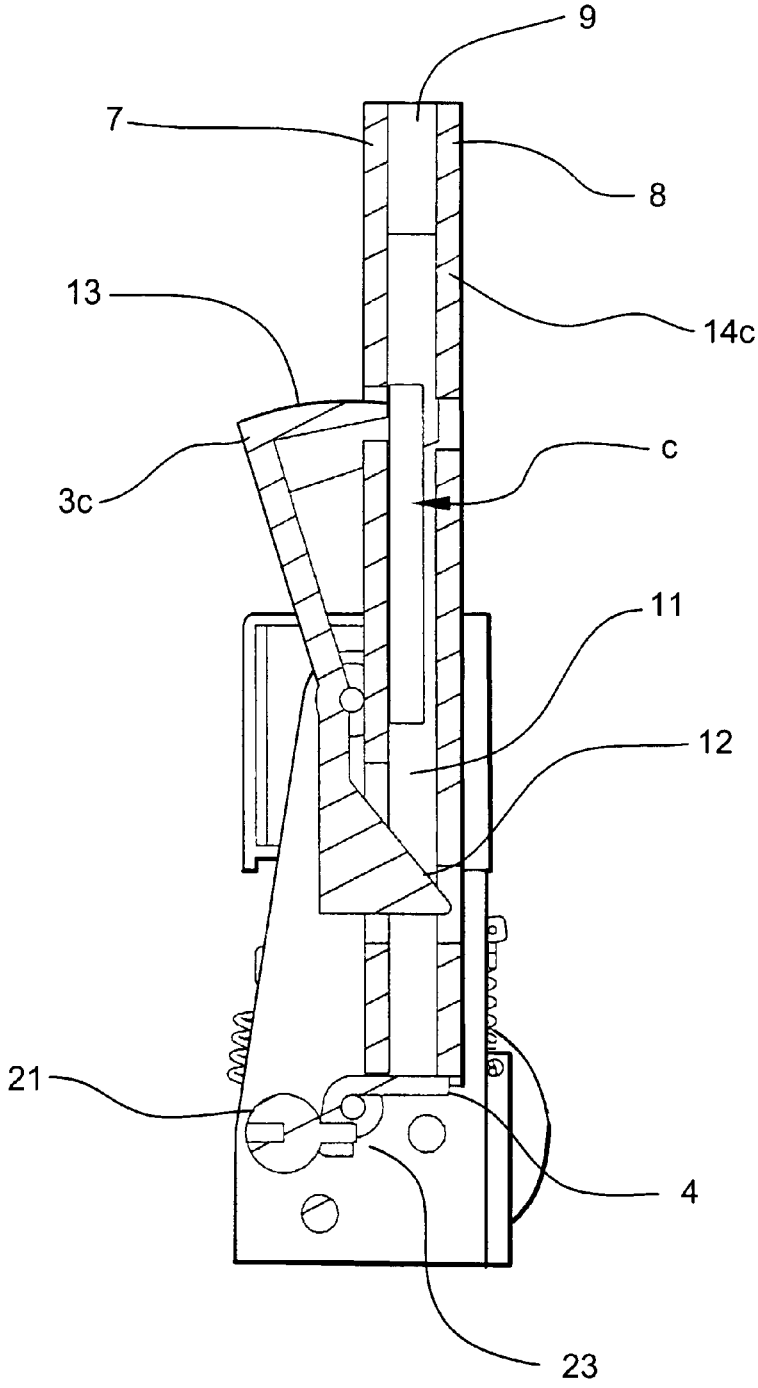
FIG. 3 is a sectional view of the apparatus of FIG. 1 viewed from the right.
Figure 4:
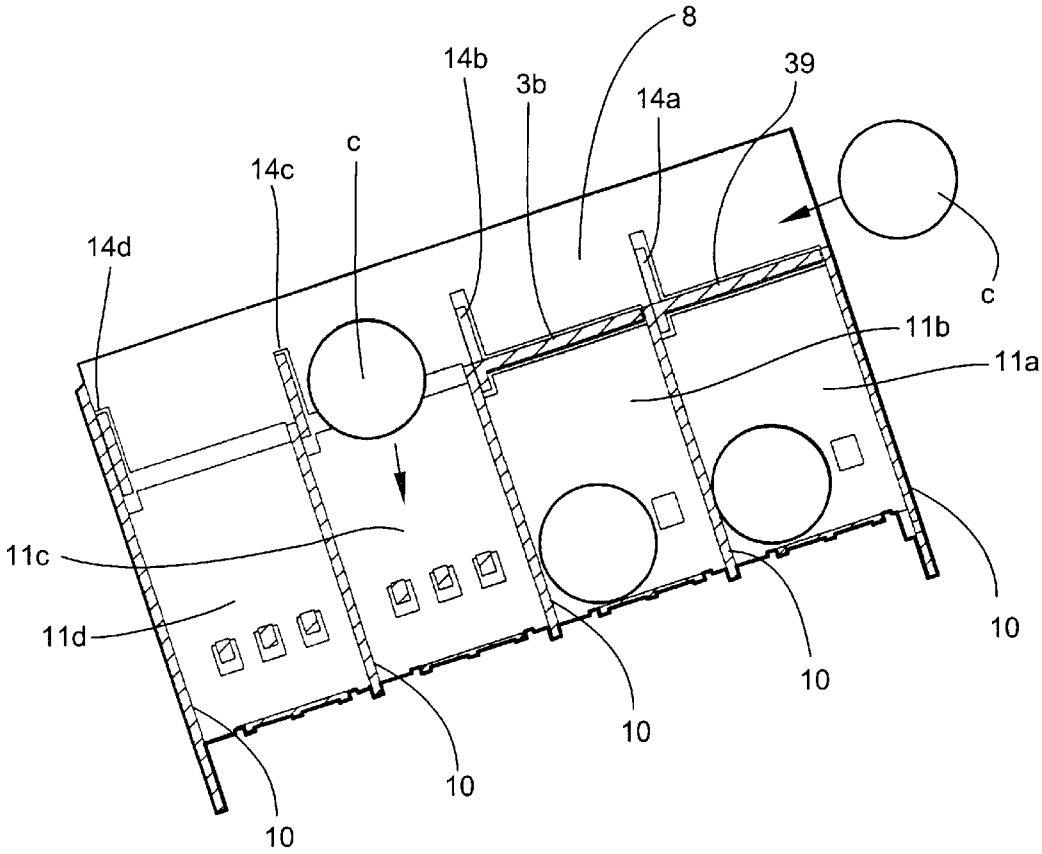
FIG. 4 is a sectional view of the apparatus of FIG. 1 viewed from the front, showing the coin guide slot and the coin stalls.

Referring now to FIGS. 1, 3, and 4, the frame 2 consists of a first side wall 7 and a second side wall 8 that are spaced apart to form a guide slot 9 providing a coin path for coins C. Referring to FIGS. 1 and 4, a series of divider walls 10 cooperate with the side walls 7 and 8 to form a series of coin stalls 11*a-d* (referred to collectively as the "stalls 11") with open tops and bottoms. The stalls 11 have an open or closed coin entry position determined by whether a control arm 13 of each gate 3 is open or closed, thereby leaving open or blocking the tops of the stalls. For example, when the gates 3 are positioned as shown in the drawing figures, stalls 11*a* and 11*b* are in the closed position because the control arms of closed gates 3*a* and 3*b* are pivoted into the coin guide slot 9 so that the coin C is blocked from entering stall 11*a* or 11*b*. Similarly, stalls 11*c* and 11*d* are in the open position because the control arms of open gates 3*c* and 3*d* are pivoted out of the coin guide slot 9 so that the coin C can fall into stall 11*c* or 11*d*. When no coins are present in the apparatus 1, all of the gates 3 are preset to the open position.

Figure 5:
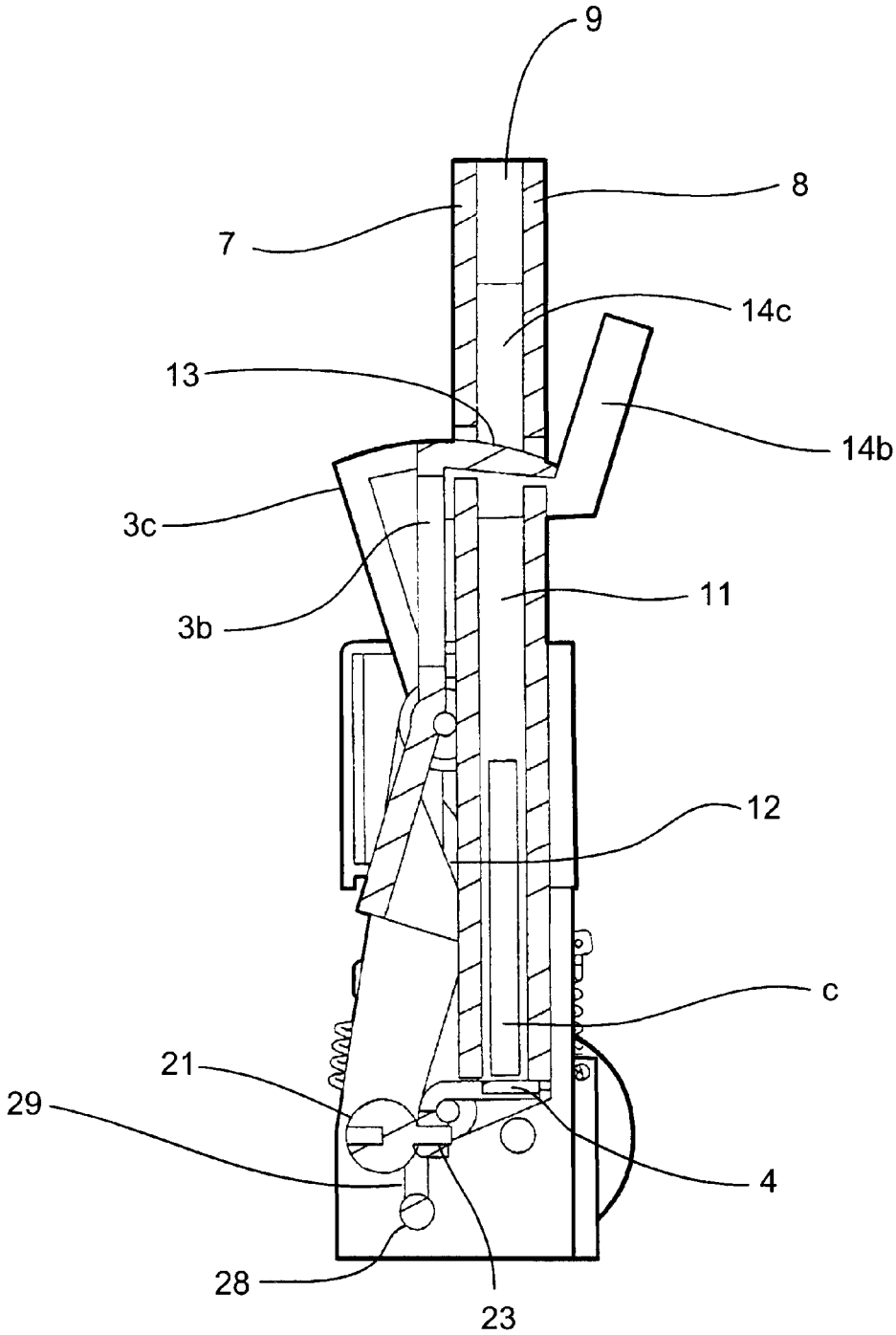
FIG. 5 is a sectional view of the apparatus of FIG. 1 viewed from the right, showing the gates in the open and closed positions.
Figure 6:
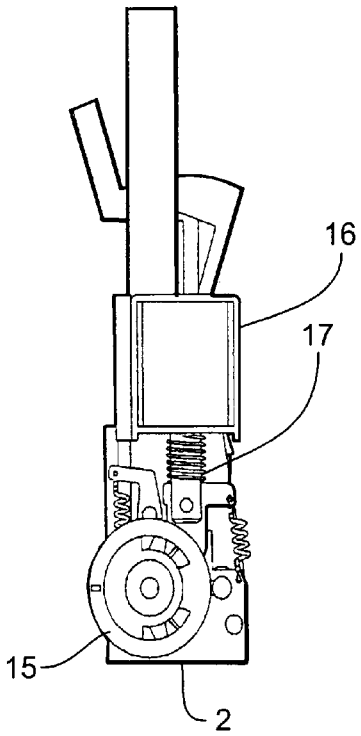
FIG. 6 is a left elevation view of the apparatus of FIG. 1, showing the actuator of the coin select mechanism.
Figure 7:
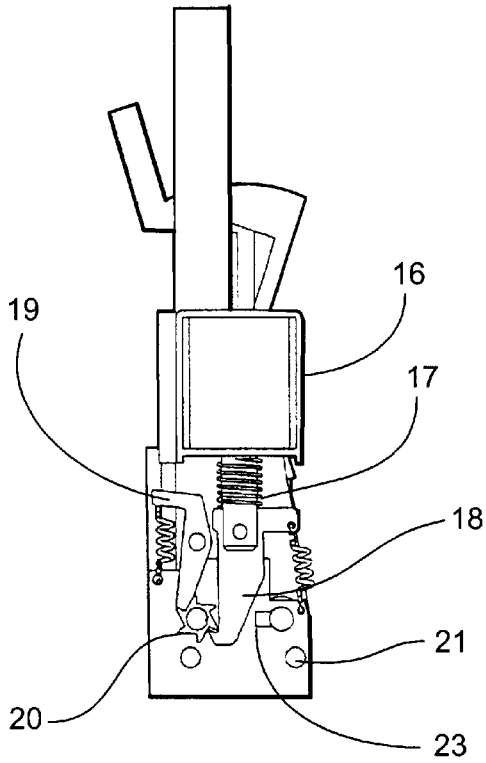
FIG. 7 is a left elevation view of the apparatus of FIG. 1 shown with a portion thereof removed for clarity of illustration.

Referring to FIGS. 3–5, the coin change apparatus 1 is mounted in the coin-operated device preferably at an angle relative to horizontal (see FIG. 4) so that a coin C in the coin guide slot 9 will roll under the force of gravity. For example, in typical commercial embodiments, the coin change apparatus 1 is mounted at an angle of between about 12 degrees and about 90 degrees. An angle of about 18 degrees typically provides a suitable amount of coin roll, however, the apparatus 1 can be disposed at another angle and still operate well. Alternatively, the coin guide slot 9 can be angled within the apparatus 1, with the gate coin control arms 13 angled similarly. When a coin C is deposited into the coin-operated device, it is guided through a coin validator (not shown) and delivered into the coin guide slot 9. The coin C then rolls down the coin guide slot 9 under the force of gravity due to the angle to the apparatus 1. The coin C enters the first available open stall 11, which when the apparatus 1 is configured as shown in FIG. 4 would be stall 11*c*.

Each of the gates 3 has a paddle 14*a*–14*d* (referred to collectively as the "paddles 14") extending from an upper portion of the corresponding gate. When the gate 3 is open, the paddle 14 is pivoted to a first position within the coin guide slot 9 (see paddle 14*c* of FIGS. 4 and 5), and when the gate is closed, the paddle is pivoted to a second position out of the coin guide slot (see paddle 14*b* of FIGS. 4 and 5). If a coin C rolls at a high velocity along the coin guide slot 9 and passes over the open stall 11*c*, it will strike the paddle 14 (now in the first position) connected to that gate 3*c*, thereby causing the coin to deflect into the open stall 11. If the coin velocity is low, the coin C falls into the open stall 11 without striking the paddle 14.

In either event, the coin C enters the coin stall 11 and approaches a cam arm 12 extending from a lower portion of the corresponding gate 3 as shown in FIG. 3 (each gate 3 has a cam arm, though only the cam arm of gate 3*b* is shown). The coin C engages the cam arm 12, and the weight of the coin causes the gate 3 to pivot to the closed position (see FIG. 5) with the coin control arm 13 of the gate 3 blocking the open top of the stall 11. The coin 9 then rests on the arm 4 blocking the bottom of that stall 11. Subsequent coins then can be placed into the apparatus 1 and will be received in the next open stall 11.

Figure 9A:
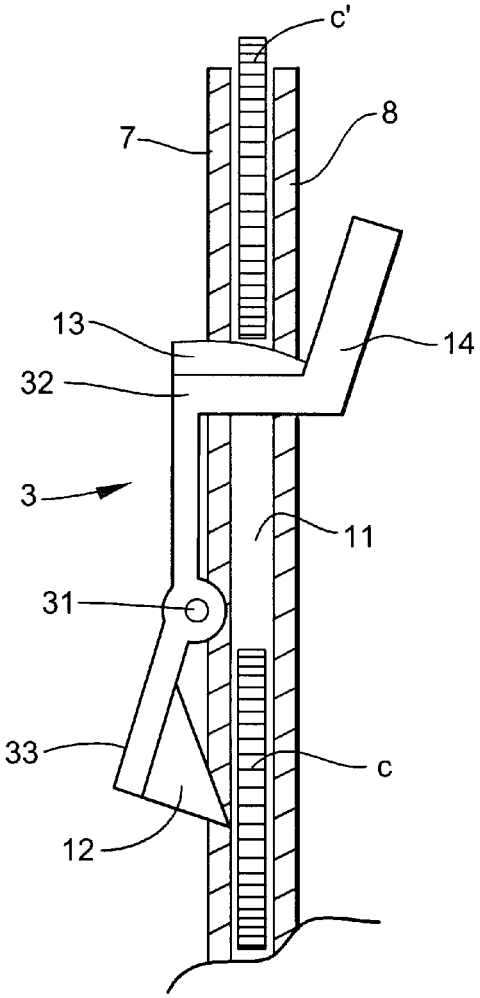
FIG. 9A is a sectional view of a portion of the apparatus of FIG. 1 viewed from the right, showing a coin in one of the coin stalls as it biases the gate to the closed position.
Figure 9B:
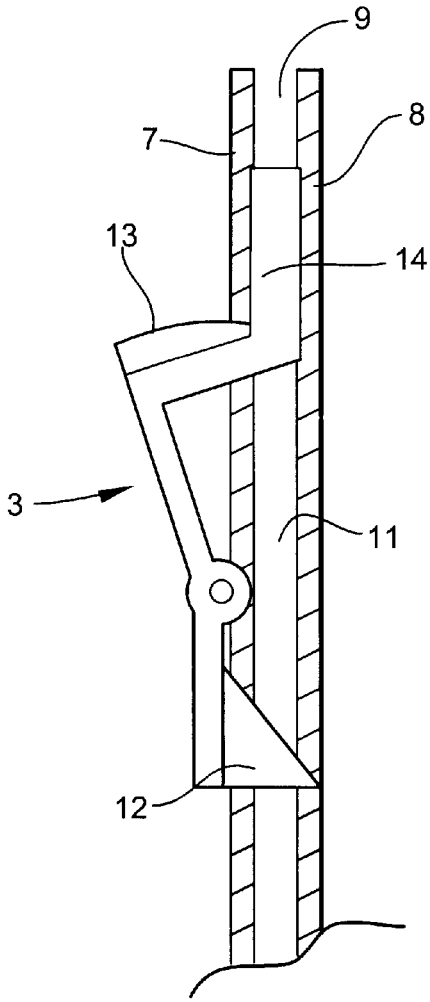
FIG. 9B is a sectional view of the portion of the apparatus of FIG. 9A, showing the gate returned to the open position.

FIGS. 9A and 9B show the operation of one of the gates 3 in greater detail. The gate 3 pivots about a pivot pin 31 or another pivotal mounting structure coupled to the frame 2. Also, the gate 3 has an upper portion 32 with the control arm 13 formed thereon and a lower portion 33 with the cam arm 12 formed thereon. In FIG. 9A, a coin C has dropped into the coin stall 11 (previously open) and engaged the cam arm 12. When the cam arm 12 is engaged by the coin C, the gate 3 is caused to pivot in one direction (for example, in a clockwise direction as shown in FIG. 9A) so that the coin control arm 13 blocks additional coins from entering the stall 11. Furthermore, when the cam arm 12 is engaged by the coin C, the gate 3 is prevented from pivoting in the opposite direction. A subsequent coin C' is shown rolling across the coin control arm 13 in the closed position, and it will continue rolling toward the next open stall 11.

FIG. 9B shows the gate 3 in the open position after the coin has been released from the stall 11, with the stall ready to receive another coin C therein. In this configuration, a coin C rolling down the coin guide slot 9 will fall into the open coin stall 11, or will fall after striking the paddle 14. The paddle 14 is disposed at or near the distal side (relative to the approaching coin) of the upper portion 32 of the gate 3 to prevent the rolling coin C from descending along the coin guide slot 9 past the open coin stall 11. After the coin C falls into the coin stall 11, the coin contacts the cam arm 12 of the gate 3 and forces it back to the closed position shown in FIG. 9A, so that the next coin will not enter the same coin stall.

In this manner, when a coin C enters the stall 11, the coin engages the cam 12 to close the stall 11 so that no more coins can enter that particular stall. Furthermore, the gates 3 are mounted to the frame 2 in an unbalanced arrangement so that the weight distribution of each gate biases it toward the open position. When the coin C is released from and exits the stall 11, the cam arm 12 is no longer engaged by the coin. Thus, when the coin C has been released from the stall 11 (as described below), the gate 3 will return to the open position automatically, ready to receive the next coin that rolls down the coin guide slot 9.

Referring now to the coin select mechanism 5, which is best understood with reference to FIGS. 2, 3, and 6–8, a coin select cam such as a barrel cam 15 is rotationally mounted to the frame 2 by a rotary axle, shaft, or the like. The barrel cam 15 has a number of teeth 20 extending therefrom and an undulating cam surface 22 formed thereon. Also, an actuator such as a solenoid 16 (or servomotor or other linear or rotary actuator) is mounted to the frame. The solenoid 16 has a plunger 17 that is connected to a lifter arm 18 that selectively engages one of the teeth 20 for rotating the barrel cam 15. A pawl 19 can be pivotally mounted to the frame 2 that also selectively engages the teeth 20, for preventing rotation of the cam 15 unless desired.

Additionally, a coin select member 21 is slidably mounted to the frame. The coin select member 21 is provided by an arm, bar, rod, or other elongate structure, and has a number of pins 23 extending therefrom. The pins 23 can be provided by bars, fingers, dowels, screws, rods, tabs, cams, knobs, arms, or other protrusions. The pins 23 can be mounted to the member 21 directly or indirectly by barrels 49 (see FIG. 2). The barrels can be releasably attached to the coin select member 21 so that the position of the pins can be adjusted. One (or more) of the pins 23*a* is engaged by the undulating cam surface 22, and the other pins 23 are configured to engage slots in the arms 4.

The arms 4 are pivotally mounted to a portion 37 of the frame 2 by pivot members such axles, shafts, or the like. The arms 4 are mounted to the frame so that they can pivot independently of each other. Each arm 4 has a slot 24*a-d* (referred to collectively as the "slots 24") into which one of the pins 23 extends. Each slot 24 has an opening 45*a-d* (referred to collectively as the "openings 45") that extends through that arm 4 so that the opening can align with and receive the pin 23 in that slot 24 to permit the arm to pivot. Alternatively, the openings 45 can extend only a portion of the way through the arms 4 to limit the pivotal travel of the arms.

In order to select one of the coins C in one of the stalls 11 for release, the solenoid 16 is selectively energized. When the solenoid 16 is energized, the lifter arm 18 pulls (or pushes) on one of the teeth 20, which causes the barrel cam 15 to rotate a desired amount. The rotating cam surface 22 on the barrel cam 15 pushes (or pulls) on the pin 23*a* and causes the coin select member 21 to slide (translate) a predetermined distance along direction 25 until the desired pin 23 lines up with the opening 45 of the slot 24 of the desired arm 4. Then the coin C resting on the arm 4 can be released by operation of the coin release mechanism 6, as described below.

All of the arms 4 are locked in place and released together by the coin release mechanism 6. Therefore, it will be understood that the coin select mechanism 5 operates to align the pins 23 on the coin select member 21 with the slots 24 in the desired arm 4 so that only the coin the stall associated with that arm will be released, while the remaining coins in the remaining coin stalls will not be released. Accordingly, the pins 23 of the coin select member 21 are positioned in a staggered relationship relative to the openings 45 in the slots 24 in the arms 4 so that only one arm is permitted to pivot at a time (see FIGS. 8 and 12).

Only one coin is released at a time, allowing for on-demand coin return. Alternatively, the pins 23 can be spaced such that they all line up with their respective slot openings at once (thereby allowing all of the coins to be released together), such that they release coins from the stalls in a randomly chosen order, or in another arrangement. Additionally, a coin select control mechanism (not shown), with electronic and/or mechanical components of a type and configuration known in the art, is provided for selectively operating the solenoid 16.

Figure 8:
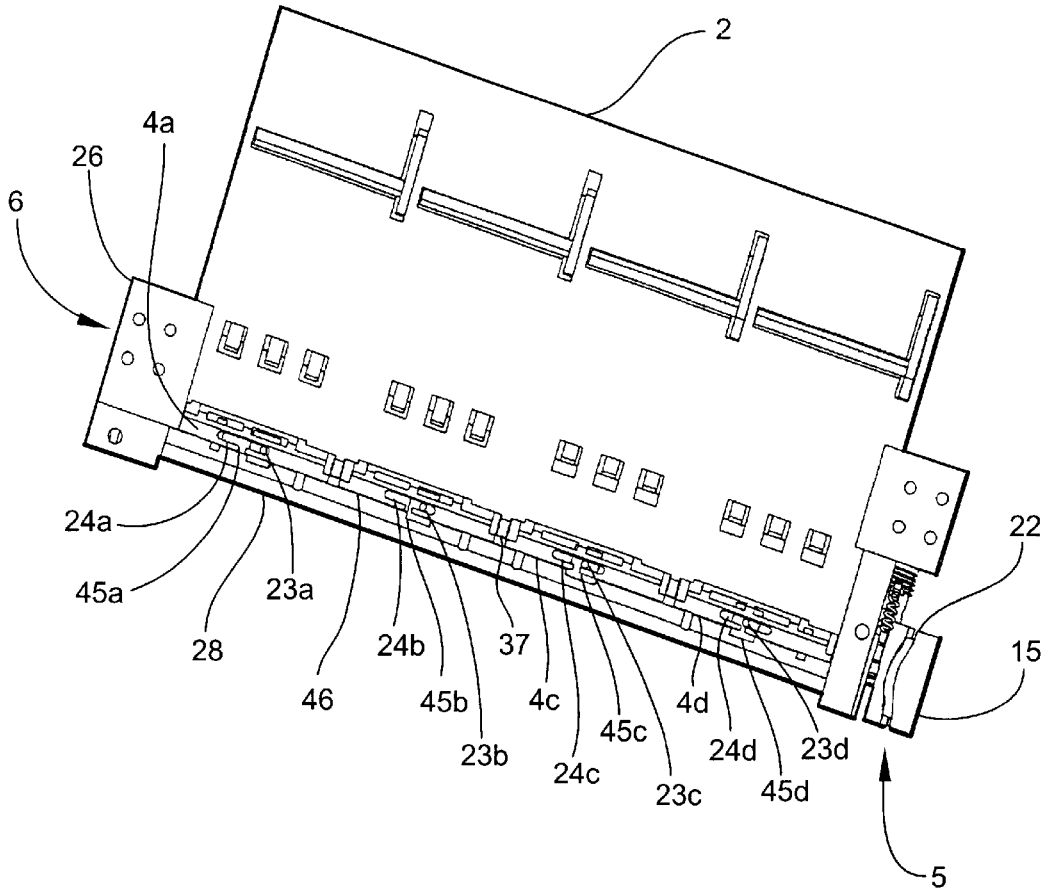
FIG. 8 is a rear elevation view of the apparatus of FIG. 1, showing the engagement of the pins on the coin select member with the slots in the support arms.
Figure 11:
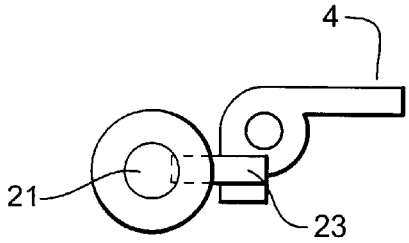
FIG. 11 is a sectional view of a portion of the apparatus of FIG. 1 viewed from the right, showing the interaction of the pins of the select member with the sot slots the support arms.
Figure 12:
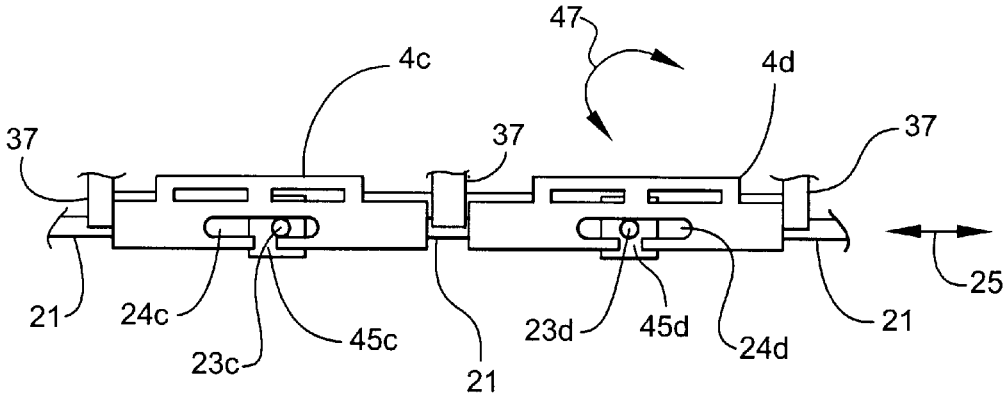
FIG. 12 is a rear elevation view of the portion of the apparatus of FIG. 11.

Referring now to FIGS. 8, 11 and 12, the coin select mechanism 5 is described in greater detail. As shown in FIG. 11, the coin select mechanism 5 includes the coin select member pins 23 that engage the slots 24 in the pivotal arms 4. Each pivotal arm 4 supports a coin C and can be pivoted out of the way to allow the coin to exit from the coin stall 11 (upon operation of the coin release mechanism 6, as described below). To prevent this from happening except when wanted, the pin 23 of the coin select member 21 interacts with the slot 24 of the pivotal arm 4.

As shown in FIGS. 8 and 12, the slot openings 45 are centrally or otherwise positioned, and are sufficiently large to allow the pin 23 to pass therethrough. In this way, the coin select member 21 can be moved selectively back and forth (in direction 25) to selectively pick a coin stall 11 to be emptied by aligning the one of the pins 23 with the opening of the slot 24 associated with that stall. Thus, when the coin select member 21 is positioned by the solenoid 26 as shown in FIGS. 8 and 12, only pin 23*d* aligns with the opening 45*d* in the slot 24*d*. In this position, only arm 4*d* can pivot (in direction 47) about its shaft, so that only stall 11*d* can be emptied.

However, arm 4*c* is prevented from pivoting by the engagement of the pin 23*c* in the associated slot 24*c*. Thus, even when the other arms 4*a-c* are released by the coin release mechanism 6, they will not pivot to release the coin resting thereon because their openings 45 are not in alignment with the pins 23 in their slots 24. Alternatively, the pins 23 can be spaced so that they all either engage or disengage together or otherwise. In such a manner, all the coin stalls 11 could be emptied at once or randomly, as may be desired in a particular situation.

Figure 10A:
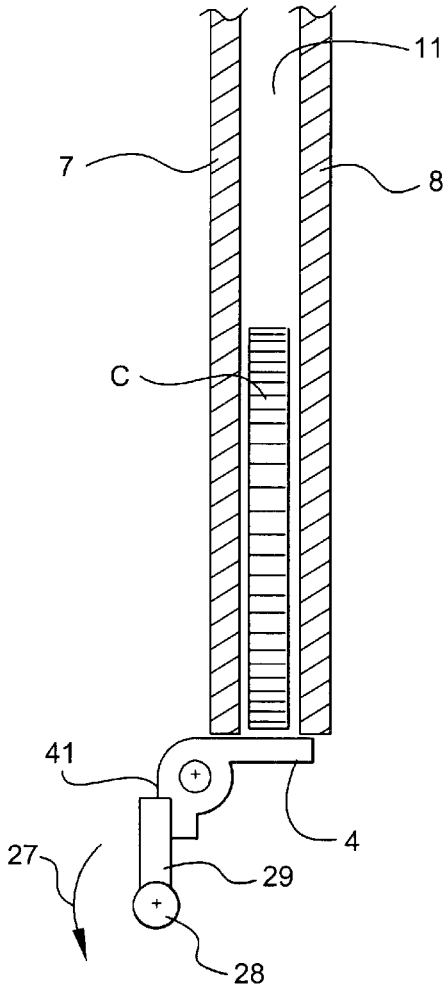
FIG. 10A is a sectional view of a portion the apparatus of FIG. 1 viewed from the right, showing a coin locked in one of the coin stalls by the coin release mechanism.

Now describing the coin release mechanism 6, and referring to FIGS. 1, 5, 10A and 10B, an actuator such as a solenoid 26 (or servomotor or other linear or rotary actuator) is mounted to the frame 2. The solenoid has a plunger 27 that is connected to a lever arm 35 that is connected to a release member 28. The release member 28 is provided by an arm, bar, rod, or other elongate structure that is rotationally mounted to the frame 2 by an axle, shaft, or the like. The release member 28 has a number of pins 29 extending therefrom that contact lock tabs 41 extending from the arms 4 to hold the arms in the locked position, as shown in FIG. 10A. The pins 29 can be provided by arms, plates, bars, fingers, dowels, tabs, cams, knobs, screws, rods, or other protrusions.

Figure 10B:
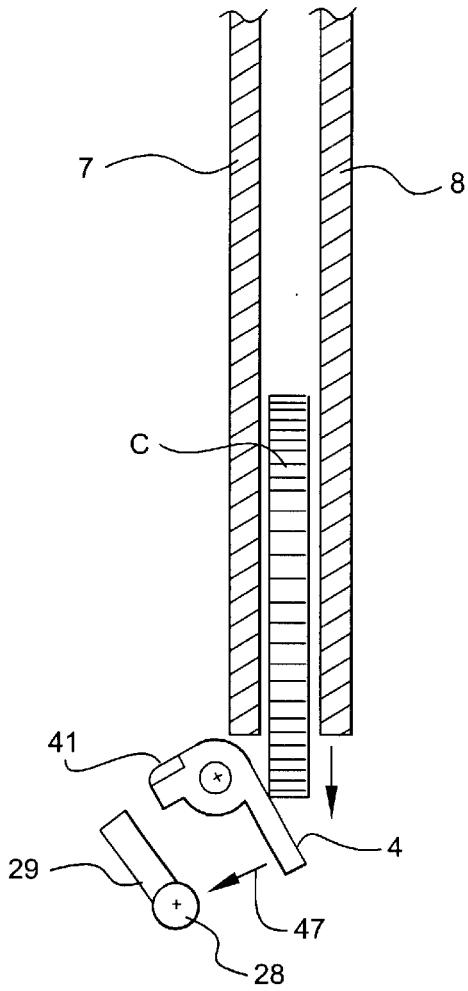
FIG. 10B is a sectional view of the portion of the apparatus of FIG. 10A, showing the operation of the coin release mechanism to discharge the coin from the stall.

When a coin C is to be released from the coin changer apparatus 1, the solenoid 26 is energized causing the release member 28 to rotate in direction 27 as shown in FIG. 10A, thereby releasing one or more of the arms 4. The coin C in the selected stall 11 (as described above) then pushes the arm 4 down and open, and falls out of the apparatus 1, as shown in FIG. 10B. A coin delivery slot (not shown) can be provided for guiding the released coin to the customer. Additionally, a slot release control mechanism (not shown), with electronic and/or mechanical components of a type and configuration known in the art, is provided for selectively operating the solenoid 26 in cooperation with the coin select control mechanism.

In operation, the coin select solenoid 16 is selectively energized to cause the coin select member 21 to slide until the desired pin 23 lines up with the opening 45 of the slot 24 in the desired arm 4. Then the selected arm 4 is free to pivot (in direction 47) under the weight of the coin C in that stall 11, except for the coin release mechanism 6, and none of the other arms are able to pivot to release the coins stored in those stalls. Then the coin release solenoid 26 is energized, and the release member 28 is rotated to release all of the arms 4, but only the arm with a slot opening 45 aligned with the pin 23 can pivot. Accordingly, only the coin C stored in the selected stall 11 is released from the apparatus 1.

Accordingly, the opening and closing of the coin stalls (to permit a coin to enter an available stall, prevent additional coins from entering an occupied stall, and reset a vacated stall to the open position), is accomplished automatically without the need for power. Also, the barrel cam and coin select actuator arrangement, which indexes the coin select member from one position to the next, provides the advantage of having a low moving mass and low cost. Additionally, no coins need be moved when selecting a coin for release. In this way, the power requirements to select a coin for release are significantly less that those of other known coin changer devices. Furthermore, the eventual release of the coins is accomplished by the coin release actuator and the weight of the coins, so that very little power is required for this function. In this manner, the present invention provides a coin escrow and changer apparatus that has very low power requirements relative to known changer devices.

In alternative embodiments, instead of the coin select cam teeth and solenoid arrangement, a stepper motor can be provided for incrementally moving the coin select member so that its pins align with the opening of the desired slot. Also, the coin select barrel cam can be provided by a cam structure other than a barrel cam, such as a pivotal lever that engages the coin select member. Additionally, the solenoid can be positioned to linearly drive the coin select member so that the coin select cam is not needed. Furthermore, the trap door of the arm can be provided by a series of bars or tines, a solid member, or by other structures.

It will be understood that the terms "one," "a," and "an" as used herein are not intended to mean only one but also can mean a number greater than one, unless expressly stated otherwise. Furthermore, terms used in the plural form are not intended to mean only more than one but also can mean just one. While the invention has been disclosed in preferred forms, those skilled in the art will recognize that many modifications, additions, and deletions can be made therein without departing from the spirit and scope of the invention as set forth in the following claims.

What is claimed is:

1. A coin escrow and changer apparatus, comprising:

a frame having a plurality of coin stalls formed therein, each stall having an open upper portion adapted to receive a coin into the stall; and a plurality of gates movable between an open position and a closed position, each gate having an upper portion with a control arm extending therefrom and a lower portion with a cam arm extending therefrom, each one of the gates associated with one of the stalls so that when the gate is disposed in the open position the control arm does not block the corresponding stall upper portion so that the coin can enter the stall and the cam arm extends into the coin stall, and so that when the coin is received in the stall the coin engages the cam arm to move the gate into the closed position wherein the control arm extends into the upper portion of the corresponding coin stall and blocks a next coin from entering the coin stall.

2. The apparatus of claim 1, wherein the gates are disposed in an unbalanced arrangement so that when the cam arm is not engaged by the coin, the gate moves to the open position.

3. The apparatus of claim 1, wherein the gates are pivotally mounted to the frame.

4. The apparatus of claim 1, wherein each of the stalls has an open lower portion, and further comprising a coin select mechanism having a plurality of movable support arms that are movable between an open position and a closed position, each one of the support arms associated with the lower portion of one of the stalls so that when the support arm is disposed in the closed position it blocks the lower portion of the corresponding stall so that the coin can not exit the stall and when the support arm is disposed in the open position it does not block the lower portion of the corresponding stall so that the coin can exit the stall.

5. The apparatus of claim 4, further comprising a coin release mechanism having a movable release member with pins extending therefrom that move between a locked position securing the arms in the closed position and a release position wherein the arms are free to move to the open position.

6. The apparatus of claim 1, wherein the frame has a coin guide slot formed therein that is in communication with the open upper portions of the coin stalls.

7. The apparatus of claim 6, wherein the coin guide slot is disposed at an angle relative to horizontal.

8. The apparatus of claim 6, wherein each of the gates has a paddle extending from the upper portion thereof, each one of the paddles associated with one of the stalls so that when the gate is disposed in the closed position the paddle does not block the coin guide slot and when the gate is disposed in the closed position the paddle extends into and blocks the coin guide slot so that the coin in the coin guide slot does not pass the corresponding stall.

9. The apparatus of claim 8, wherein the paddle is disposed at a distal side of the gate relative to the approaching coin in the angled coin guide slot.

10. A coin escrow and changer apparatus, comprising:

a frame having a plurality of coin stalls formed therein, each stall having an open lower portion adapted to permit a coin to exit the stall;

a coin select mechanism having a plurality of movable support arms and a coin select member, the support arms movable between an open position and a closed position, each one of the support arms associated with the lower portion of one of the stalls so that when the support arm is disposed in the closed position it blocks the lower portion of the corresponding stall so that the coin can not exit the stall and when the support arm is disposed in the open position it does not block the lower portion of the corresponding stall so that the coin can exit the stall, the coin select member engaging the support arms so that the support arms are prevented from moving to the open position and movable to disengage one or more of the support arms to permit the disengaged support arm to move to the closed position.

11. The apparatus of claim 10, wherein the support arms are mounted to the frame so that they are free to move independently of each other.

12. The apparatus of claim 10, wherein the coin select member has a plurality of pins extending therefrom and each of the support arms has a slot defined therein with an opening portion, wherein the pins extend into the slots to secure the support arms in the closed position and, when one of the pins is aligned with one of the openings, the pin can extend into the opening to permit the support arm to move to the open position.

13. The apparatus of claim 12, wherein the pins are disposed on the coin select member in a staggered arrangement relative to the openings so that only one support arm at a time can move to the open position.

14. The apparatus of claim 10, wherein the coin select mechanism further comprises an actuator operatively coupled to the coin select member.

15. The apparatus of claim 14, wherein the coin select mechanism further comprises a barrel cam operatively coupled to the actuator, wherein the barrel cam has a cam surface formed thereon that engages one of the pins of the coin select member.

16. The apparatus of claim 10, further comprising a coin release mechanism having a movable release member that moves between a locked position securing the arms in the closed position and a release position wherein the arms are free to move to the open position.

17. The apparatus of claim 16, wherein each of the support arms has a lock tab and the release member has pins extending therefrom that engage the lock tabs when the release member is disposed in the locked position and that do not engage the lock tabs when the release member is disposed in the release position.

18. The apparatus of claim 10, wherein each stall has an open upper portion adapted to receive a coin into the stall, and further comprising a plurality of gates movable between an open position and a closed position, each gate having an upper portion with a control arm extending therefrom and a lower portion with a cam arm extending therefrom, each one of the gates associated with one of the stalls so that when the gate is disposed in the open position the control arm does not block the corresponding stall upper portion so that the coin can enter the stall and the cam arm extends into the coin stall, and so that when the coin is received in the stall the coin engages the cam arm to move the gate into the closed position wherein the control arm extends into an upper portion of the corresponding coin stall and blocks a next coin from entering the coin stall.

19. The apparatus of claim 18, wherein the frame has a coin guide slot formed therein that is in communication with the open upper portions of the coin stalls and that is disposed at an angle relative to horizontal.

20. A coin escrow and changer apparatus, comprising:

a frame having a plurality of coin stalls formed therein, each stall having an open upper portion adapted to receive a coin into the stall and an open lower portion adapted to permit a coin to exit the stall;

a coin guide slot formed in the frame, in communication with the open upper portions of the coin stalls, and disposed at an angle relative to horizontal;

a plurality of gates pivotally mounted to the frame and pivotal between an open position and a closed position, each gate having an upper portion with a control arm extending therefrom and a lower portion with a cam arm extending therefrom, each one of the gates associated with one of the stalls so that when the gate is disposed in the open position the control arm does not block the corresponding stall upper portion so that the coin can enter the stall and the cam arm extends into the lower portion of the corresponding coin stall, and so that when the coin is received in the stall the coin engages the cam arm to pivot the gate into the closed position wherein the control arm extends into the upper portion of the corresponding coin stall and blocks a next coin from entering the coin stall, wherein the gates are disposed in an unbalanced arrangement so that when the cam arm is not engaged by the coin, the gate pivots to the open position;

a coin select mechanism having a plurality of pivotal support arms and a slidable coin select member, the support arms pivotal between an open position and a closed position, each one of the support arms associated with the lower portion of one of the stalls so that when the support arm is disposed in the closed position it blocks the lower portion of the corresponding stall so that the coin can not exit the stall and when the support arm is disposed in the open position it does not block the lower portion of the corresponding stall so that the coin can exit the stall, the coin select member engaging the support arms so that the support arms are prevented from pivoting to the open position and slidable to disengage one or more of the support arms to permit the disengaged support arm to pivot to the closed position; and a coin release mechanism having a release member with pins extending therefrom that pivot between a locked position engaging lock tabs on the support arms to secure the arms in the closed position and a release position wherein the arms are free to move to the open position.

21. The apparatus of claim 20, wherein each of the gates has a paddle extending from the upper portion thereof at a distal end of the gate relative to the approaching coin in the angled coin guide slot, each one of the paddles associated with one of the stalls so that when the gate is disposed in the closed position the paddle does not block the coin guide slot and when the gate is disposed in the open position the paddle extends into and blocks the coin guide slot so that the coin in the coin guide slot does not pass the corresponding stall.

22. The apparatus of claim 20 further comprising an actuator operatively coupled to the release member.

23. The apparatus of claim 20, wherein the support arms are mounted to the frame so that they are free to pivot independently of each other.

24. The apparatus of claim 20, wherein the support arms pivot from the closed position to the open position by the weight of the coin resting on the support arm.

25. The apparatus of claim 20, wherein the coin select member has a plurality of pins extending therefrom and each of the support arms has a slot defined therein with an opening portion, wherein the pins extend into the slots to secure the support arms in the closed position and, when one of the pins is aligned with one of the openings, the pin can extend into the opening to permit the support arm to move to the open position.

26. The apparatus of claim 25, wherein the pins are disposed on the coin select member in a staggered arrangement relative to the openings so that only one support arm at a time can pivot to the open position.

27. The apparatus of claim 20, wherein the coin select mechanism further comprises an actuator operatively coupled to the coin select member.

28. The apparatus of claim 27, wherein the coin select mechanism further comprises a barrel cam operatively coupled to the actuator, wherein the barrel cam has an undulated cam surface formed thereon that engages one of the pins of the coin select member.

29. The apparatus of claim 28, wherein the barrel cam has teeth formed thereon, and further comprising a lifter arm that is coupled to the actuator and that engages the teeth.

* * * * *